US008875329B2

(12) United States Patent
Gomez

(10) Patent No.: US 8,875,329 B2
(45) Date of Patent: Nov. 4, 2014

(54) ARM TUCKING DEVICE FOR USE WITH AN OPERATING ROOM TABLE

(71) Applicant: David Julian Gomez, Raleigh, NC (US)

(72) Inventor: David Julian Gomez, Raleigh, NC (US)

( * ) Notice: Subject to any disclaimer, the term of this patent is extended or adjusted under 35 U.S.C. 154(b) by 0 days.

(21) Appl. No.: 13/792,390

(22) Filed: Mar. 11, 2013

(65) Prior Publication Data

US 2014/0250601 A1 Sep. 11, 2014

(51) Int. Cl.
*A61G 13/12* (2006.01)

(52) U.S. Cl.
CPC ..... *A61G 13/1235* (2013.01)
USPC ..... 5/623; 5/621; 5/646; 128/845

(58) Field of Classification Search
USPC ..... 5/621–624, 646, 648; 128/845
See application file for complete search history.

(56) References Cited

U.S. PATENT DOCUMENTS 1,279,120 A * 9/1918 Kellogg ..... 607/115
2,658,211 A * 11/1953 Bendersky ..... 5/646
2,895,775 A * 7/1959 McDonald et al. ..... 5/618
2,910,259 A * 10/1959 Johnson ..... 248/118
3,020,909 A * 2/1962 Stevens ..... 602/39
3,124,328 A * 3/1964 Kortsch ..... 248/118
3,339,913 A * 9/1967 Anderson ..... 5/600
3,540,719 A * 11/1970 Jensen et al. ..... 5/647
4,426,071 A * 1/1984 Klevstad ..... 5/602
5,027,799 A * 7/1991 Laico et al. ..... 602/20
5,056,535 A * 10/1991 Bonnell ..... 128/882
5,135,210 A * 8/1992 Michelson ..... 5/658
5,281,001 A * 1/1994 Bergsten et al. ..... 297/411.24
5,418,988 A * 5/1995 Iura ..... 5/430
5,507,050 A * 4/1996 Welner ..... 5/600
5,560,577 A * 10/1996 Keselman ..... 248/279.1
5,582,379 A * 12/1996 Keselman et al. ..... 248/279.1
5,940,912 A * 8/1999 Keselman et al. ..... 5/623
5,961,085 A * 10/1999 Navarro et al. ..... 248/279.1
6,195,820 B1 * 3/2001 Heimbrock et al. ..... 5/623
6,708,935 B2 * 3/2004 Smeed ..... 248/118
7,452,032 B1 * 11/2008 Roleder et al. ..... 297/330
7,520,007 B2 * 4/2009 Skripps ..... 5/621
7,832,035 B2 * 11/2010 Walczyk ..... 5/648
8,028,702 B2 * 10/2011 Dasilva ..... 128/845
8,302,228 B2 * 11/2012 Aboujaoude ..... 5/648
8,322,342 B2 * 12/2012 Soto et al. ..... 128/845
8,745,786 B2 * 6/2014 Andrienko et al. ..... 5/430
2004/0123389 A1 * 7/2004 Boucher et al. ..... 5/623

* cited by examiner

*Primary Examiner* — William Kelleher
*Assistant Examiner* — David R Hare
(74) *Attorney, Agent, or Firm* — Phillips Lytle LLP; David L. Principe

(57) ABSTRACT

An arm tucking device for use with an operating room table. The arm tucking device includes a structural member and an elongate arm support member that is pivotally attached to the structural member. An angular locking mechanism adjustably fixes the angle between the arm support member and the structural member. The arm support member can be rotated toward the table from a first position to a second position.

15 Claims, 7 Drawing Sheets

ARM TUCKING DEVICE FOR USE WITH AN OPERATING ROOM TABLE

FIELD OF THE INVENTION

The present invention relates generally to the field of perioperative positioning devices, and more particularly to a device and a method for use with surgical cases that require bilateral arm securing/tucking/stowing while in the supine position.

BACKGROUND OF THE INVENTION

Secure arm positioning is used typically during procedures such as, but not limited to, lithotomy based, laparascopic, daVinci robot or other indicated surgical cases where the surgeon or procedure necessitates that the arms of the patient be placed against the patient's body in order to adequately access the surgical field.

There have been many research articles written on the subject of patient upper extremity nerve, vascular, or skin integrity injuries occurring during different surgical procedures. These injuries may occur under numerous circumstances, and sometimes despite proper stowing techniques, injuries may still result.

There are a few factors that contribute to these type of injuries. The patient's body habitus or size with regard to obesity or extreme instances of frailty may play a significant role in the increased incidence of injuries. Extremely thin, elderly or emaciated individuals with thin arms, lack of adipose tissue, and overt bony prominences may pose problems despite best efforts to protect the upper extremities.

One example of an accepted positioning standard is the use of padding and a draw sheet (sheet folded under the patient) to tuck and stow an arm during a surgical procedure. The purpose of the draw sheet is to use the patient's own distributed weight to hold the sheet and arm in place while the arm is wrapped. While this technique is currently the standard of care accepted by many practitioners, there are some drawbacks. The use of draw sheets can cause potential injuries when the patient's weight is used to secure the arm. For example, during extreme table positioning, the patient's weight is unevenly distributed thereby potentially causing a tourniquet, or tightening effect that may cause damage despite adequate use of padding. These types of injuries related to arm tucking may also increase depending on the amount of time that the patient is undergoing the procedure.

While most patients have no problem with accepted stowing practices, there has been a significant shift in patient population due to an increase in co-morbidities, especially with respect to body size (obesity). When a larger patient is laying on a table that does not fully account for the girth of the patient, this decreases the surface area of the table that is available to stow the arms correctly at the patient's side because of the reduction of the surface area of the table available for the arms to securely rest on.

There are a few existing devices that may be used. For example, a standard arm-board may be placed at the patient's side perpendicular to the direction of the table. The problem with the linear-placed arm-board is that the surgeon or surgical staff must reach over a larger surface area with regard to the arm-board's position to reach the surgical field.

Another device is a sled-type device that slides under the mattress of the operating table thereby using the weight of the patient to secure the patient's arm closer to their body. The sled-type device may be difficult to place under a patient-weighted mattress. Hospital mattresses are typically tethered to the mattress frame with hook and loop fasteners. The hook and loop fasteners are placed in the midportion of the underside of the mattress, and these fasteners help secure the mattress to the frame. Theoretically, any disruption with regard to the hook and loop fasteners caused by the sled could cause movement of the mattress and/or patient during extreme surgical table positions resulting in injury. The sleds can also potentially rip the mattress because the sled is forced under a weighted (from the patient's own weight) mattress thereby causing potential tears in the fabric covering the mattress. These tears can ruin the integrity of the mattress which could then become a potential place for bodily fluids, blood, or other biohazard materials to collect during surgical procedures, thereby increasing the opportunity for cross infection to both patients and staff.

What is needed is an arm tucking device with a low profile that prevents injuries and is suitable for use with a wide variety of patients.

BRIEF SUMMARY OF THE INVENTION

With parenthetical reference to the corresponding parts, portions or surfaces of the disclosed embodiment, merely for the purposes of illustration and not by way of limitation, the present invention provides an arm tucking device.

The present invention meets the above described need by providing a detachable arm tucking device (19) that is easily added to the existing operating room table bed rail and will allow for ease of use by just one caregiver instead of two or three caregivers currently utilized with the accepted standards of tucking and stowing arms with padding and a draw sheet.

The overall design of the present invention serves numerous functions. The cutout portions of the arm tucking device (19) provide for leaving the ulnar and lateral radial nerves of the upper arm padded yet exposed for visualization. The curvature of the distal end (41) of the arm tucking device (19) also provides for visualization and access to the commonly used intravenous (IV) access currently started in the dorsal aspect of the hand for the majority of surgeries. The curvature of the device (19) also allows for visualization and access to the radial artery for invasive radial arterial line monitoring. The fingers will also be exposed for visualization (especially for surgical lithotomy positions) so that integrity can be assessed and $SPO_2$/Pulse $O_2$ finger probes can be adjusted easily.

The present invention fits into existing operating table bed rail clamps allowing secure and adjustable positioning and tension. Once the device (19) is attached to the bed, the hinged arm support member (20) that cradles and protects the arm can be adjusted based on the patient's arm size and its relation to the operating table. The device (19) cradles the arm and secures it safely against the patient's body thereby distributing force and pressure in a way that does not harm the patient. The adjustable height feature allows the invention to be used on various beds with different mattress heights which increases its utility and decreases the cost to hospitals because they will not have to stock different versions for different bed types. The angular locking mechanism (81) allows the device (19) to be adjusted and locked into position thereby decreasing any potential for tightening against the patient during the surgical procedure due to table movement or staff leaning against the table during surgery.

The device may further comprise an arm tucking device (19) for use with an operating room table. The arm tucking device (19) has a structural member (23). An elongate arm support member (20) is pivotally attached to the structural member (23). An angular locking mechanism (81) provides for adjustably fixing an angle between the arm support member (20) and the structural member (23). The arm support member (20) can be rotated toward the operating table from a first position to a second position.

The device (19) may further comprise at least one pin (83) fixed relative to one of the arm support member (19) and the structural member (23). A plurality of openings (98*a-d*) are fixed relative to one of the arm support member (20) and the structural member (23). The arm support member (20) can be rotated such that the at least one pin (83) engages with one of the plurality of openings (98*a-d*).

In another aspect, the arm support member (20) of the device (19) has a cross-sectional shape taken perpendicular to the central longitudinal axis (35) that includes a curve.

The device (19) may further comprise the arm support member (20) having a top surface (26) with first and second side edges (29, 32) disposed opposite from each other. The first and second side edges (29, 32) are disposed in spaced apart relation. The first side edge (29) extends inward toward the center of the top surface (26) of the arm support member (20) along an axial midportion of the arm support member (20).

In another aspect, the first and second side edges (29, 32) extend to a distal edge (41) disposed opposite from a proximal edge (38). The distal edge (41) has a first portion (44) and a second portion (47), and the second portion (47) of the distal edge (41) extends beyond the first portion (44) to form a protuberance (50).

In another aspect, the first and second side edges (29, 32) curve inward toward the center of the top surface (26) of the arm support member (20) and the radius of curvature of the first side edge (29) is less than the radius of curvature of the second side edge (32).

In another aspect, one of the first and second side edges (29, 32) extend inward to expose the ulnar nerve region of a patient whose arm is resting on the device (19).

In another aspect, the plurality of openings (98*a-d*) are disposed in a curved path.

The device (19) may further comprise a mounting blade (68*a*, 68*b*) extending from a cross member (65). The mounting blade (68*a*,68*b*) is shaped to engage with a clamp attached to a rail on the operating table.

The device may further comprise the arm support member (20) having an L-shaped bracket (56*a*, 56*b*). The L-shaped bracket (56*a*, 56*b*) has a first leg (59*a*, 59*b*) with an opening (63*a*, 63*b*) formed therein.

In another aspect, the L-shaped bracket (56*a*, 56*b*) has a second leg (62*a*, 62*b*) substantially coplanar with the top surface (26) of the arm support member (20).

The device (19) may further comprise a support plate (71*a*, 71*b*) mounted on the cross member (65). The support plate (71*a*, 71*b*) extends through the opening (63*a*, 63*b*) in the first leg (59*a*, 59*b*) of the support bracket (56*a*, 56*b*).

In another aspect, the at least one pin (83) is mounted on the first leg (59*a*, 59*b*) of the L-shaped bracket (56*a*, 56*b*) adjacent to the opening (63*a*, 63*b*) in the first leg (59*a*, 59*b*).

In another aspect, a plurality of openings (98*a-d*) are defined in the support plate (71*a*).

DETAILED DESCRIPTION

Figure 1:
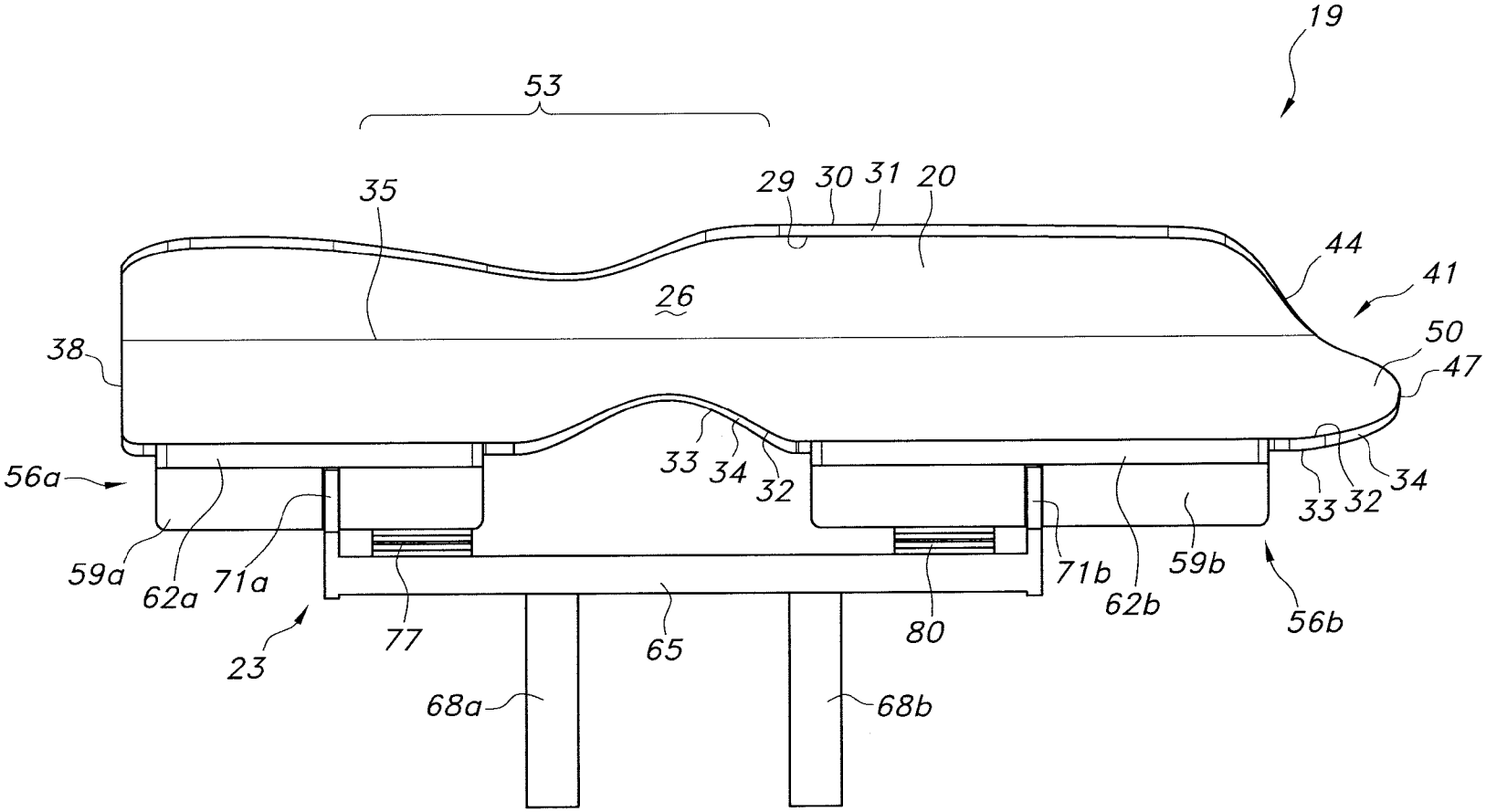
FIG. 1 is a front elevational view of the arm tucking device of the present invention in the upright "tucked" position.

At the outset, it should be clearly understood that like reference numerals are intended to identify the same structural elements, portions or surfaces consistently throughout the several drawing figures, as such elements, portions or surfaces may be further described or explained by the entire written specification, of which this detailed description is an integral part. Unless otherwise indicated, the drawings are intended to be read (e.g., cross-hatching, arrangement of parts, proportion, debris, etc.) together with the specification, and are to be considered a portion of the entire written description of this invention. As used in the following description, the terms "horizontal", "vertical", "left", "right", "up" and "down", as well as adjectival and adverbial derivatives thereof, (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or of rotation, as appropriate.

Referring now to the drawings, and more particularly to FIG. 1 thereof, the present invention provides an arm tucking device 19 for use with an operating room table. Device 19 includes an arm support member 20 that is pivotally attached to a structural member 23. In FIG. 1, the arm support member 20 is shown in the upright position. The arm support member 20 has a top surface 26 with first side edge 29 and second side edge 32. Edge 29 is spaced apart from bottom edge 30 by a thickness 31 of the member 20. Edge 32 is spaced apart from edge 33 by a distance equal to the thickness 34 of the member 20. The arm support member 20 has a central longitudinal axis 35 extending from a proximal edge 38 to a distal edge 41. The distal edge 41 has a first portion 44 and a second portion 47. The second portion 47 of the distal edge 41 extends beyond the first portion 44 to form a protuberance 50. The first side edge 29 and the second side edge 32 curve inward toward the central longitudinal axis 35 in a midportion 53 of the arm support member 20. The radius of curvature of the first side edge 29 is greater than the radius of curvature of the second side edge 32.

The arm support member 20 may include a pair of L-shaped brackets 56*a* and 56*b* having first legs 59*a* and 59*b* and second legs 62*a* and 62*b*. The second legs 62*a*, 62*b* of the brackets 56*a* and 56*b* are coplanar with the top surface 26 of the arm support member 20.

The structural member 23 includes a horizontal cross member 65. A pair of mounting blades 68*a* and 68*b* extend downward from the cross member 65. The mounting blades

68*a* and 68*b* may comprise solid rectangular metal bars and may be integrally formed with or attached to the cross member 65. Other shapes and materials suitable for a rigid support member may also be suitable. The mounting blades 68*a* and 68*b* are adapted for use with commercially available clamps that mount to existing rails on beds. An example of a clamp that attaches to a bed rail and receives a device supported by mounting blades is the ALLEN® Easy-Lock Blade Clamp which is available from AliMed, Inc. in Dedham, Mass. There are also many other common bed rail clamps that are available from other suppliers. The mounting blades 68*a* and 68*b* are inserted into clamps and the height of the device above the bed rail can be adjusted by how much of the blade 68*a* and 68*b* is inserted into the clamp. First and second support plates 71*a* and 71*b* (best shown in FIGS. 9-11) extend from the cross member 65 at opposite ends. The plates 71*a* and 71*b* may be integrally formed with the cross member 65 or may be attached to the cross member 65.

The arm support member 20 is pivotally attached to the structural member 23 by a first hinge 77 and a second hinge 80. Hinges 77 and 80 may be closed hinges suitable for use in a medical environment.

Figure 2:
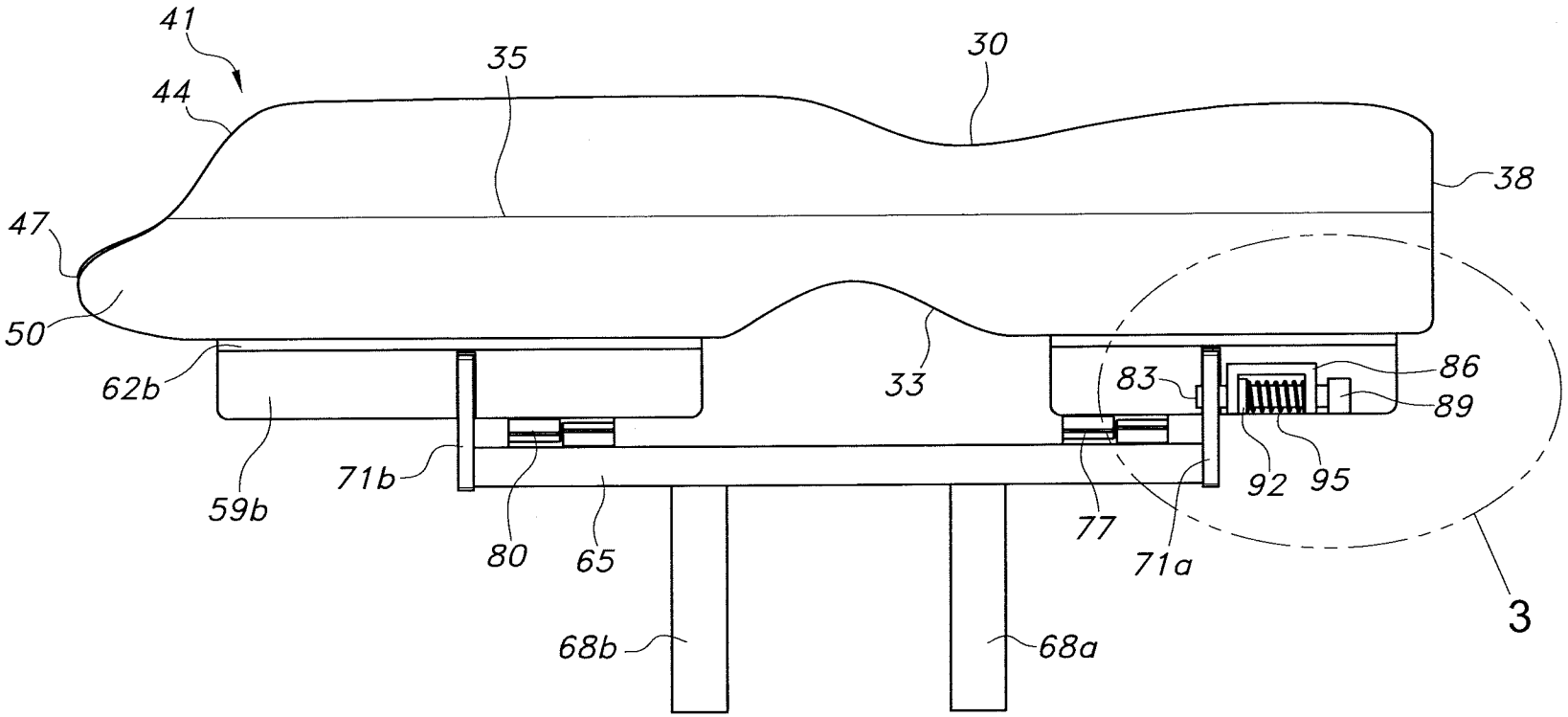
FIG. 2 is a rear elevational view of the arm tucking device shown in FIG. 1.
Figure 3:
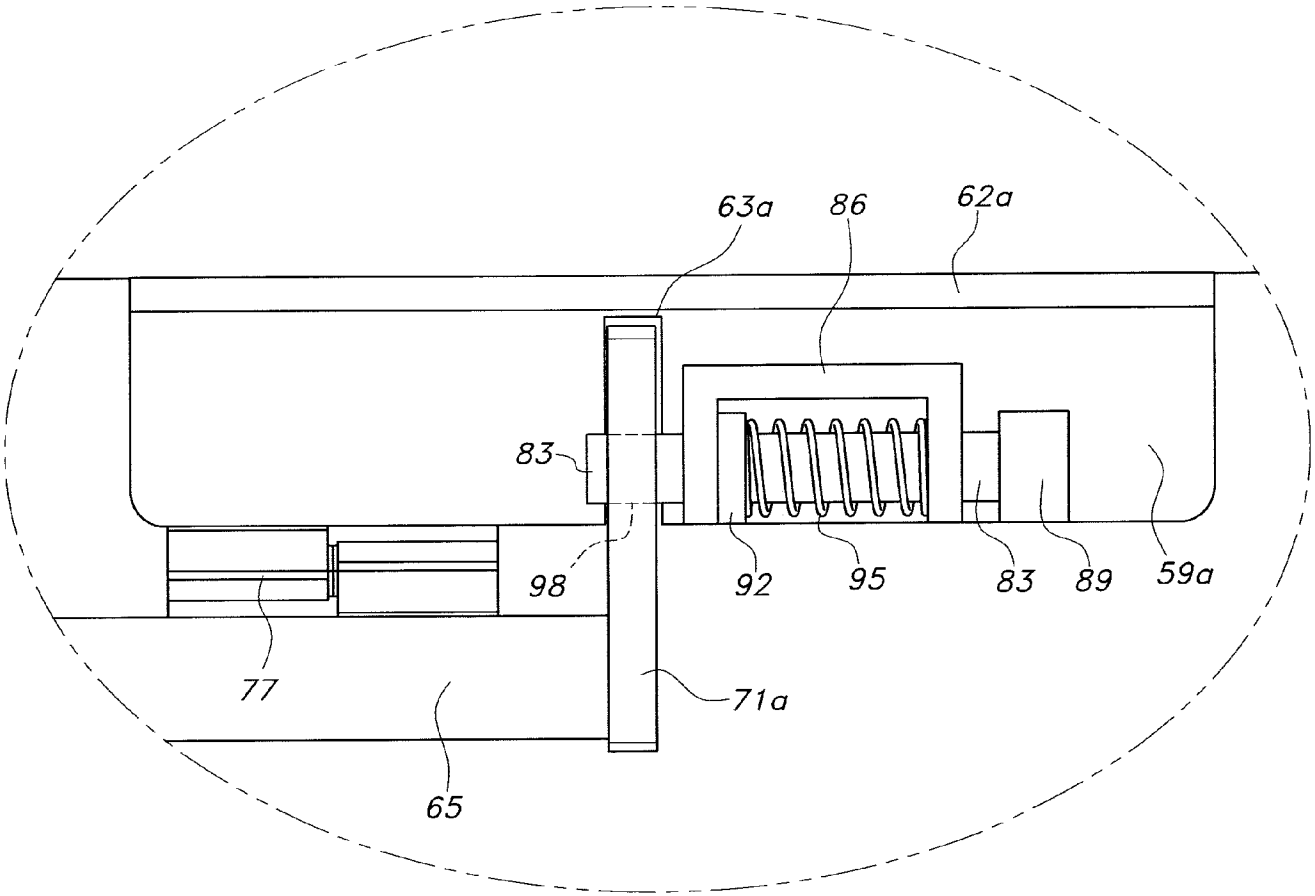
FIG. 3 is an enlarged view of a portion of FIG. 2.

Turning to FIGS. 2 and 3, the angle of the arm support member 20 relative to the structural member 23 may be selectively adjusted by an angular locking mechanism 81 such as a spring-biased pin 83. The pin 83 may be mounted to the back of leg 59*a*. A C-shaped frame 86 may be attached to leg 59*a*. The pin 83 may be provided with a head 89 and a flange 92. A spring 95 may be disposed around the pin 83 to provide a force between a portion of the frame 86 and the flange 92. The spring 95 is in compression such that it provides a leftward force against the flange 92 to urge the pin 83 into one of the openings 98*a* (best shown in FIGS. 9 and 10) in the support plate 71*a*. The pin 83 may be retracted from the opening 98*a* by pulling the head 89 of the pin 83 in the rightward direction. The spring 95 is thereby further compressed and the pin 83 slides to the right thereby exiting the opening 98*a*. With the pin 83 retracted from the opening 98*a*, the arm support member 20 can be rotated relative to the structural member 23 into a new position where the pin 83 will align with one of the openings 98*a-d* in the support plate 71*a*. Once the arm support member 20 is rotated into the new position, the head 89 can be released and the pin 83 will be urged into one of the aligned openings 98*a-d* corresponding to the new position. This adjustability provides for moving the arm tucking device 19 between a "loading" position which is substantially horizontally oriented to a "tucked" position shown in FIG. 1. While the invention has been described in connection with a hinge and a locking mechanism formed by a spring-biased pin engaging with openings in a plate, it will be evident to those of ordinary skill in the art based on this disclosure that there are numerous mechanical devices for pivotally connecting the arm support member 20 to the structural member 23 and locking the arm support member 20 in position. Other types of hinges and locks including ratchet mechanisms, racks, pawls, gears, or the like may also be designed to adjustably lock the arm support member 20 relative to the structural member 23 at various angles.

Figure 4:
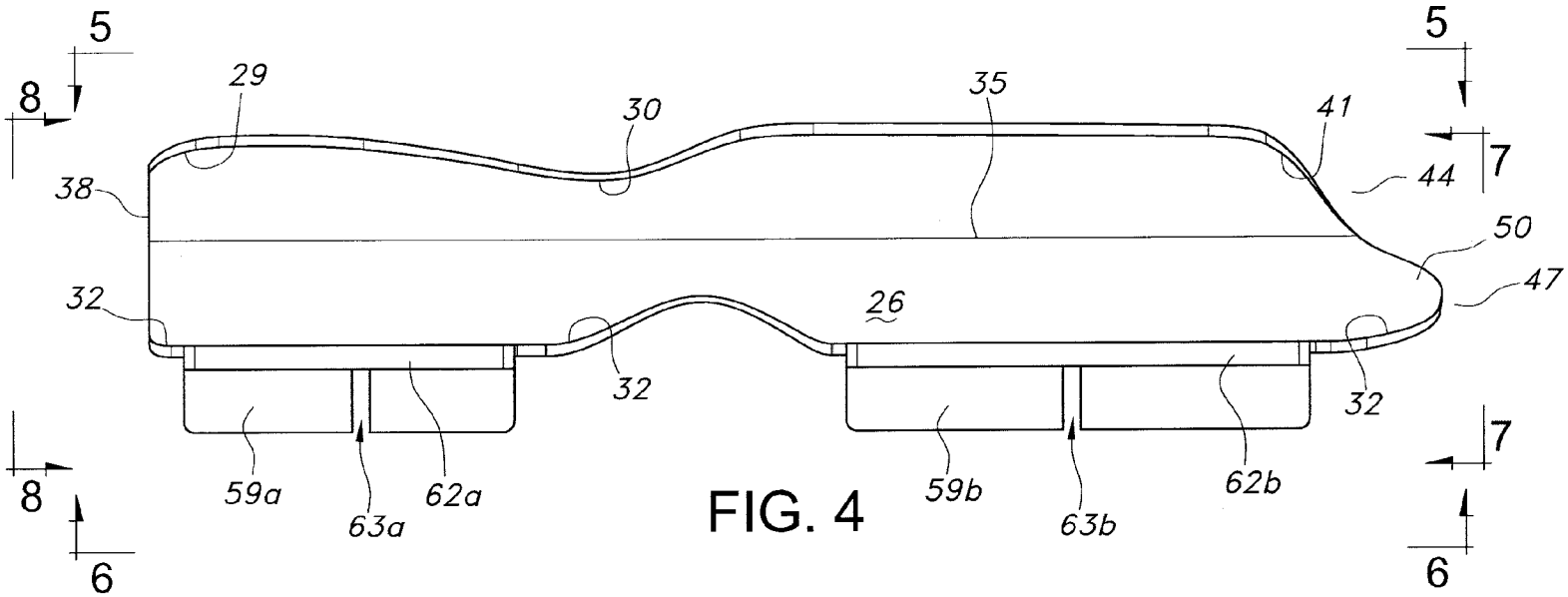
FIG. 4 is a top plan view of the arm support member of the present invention.

Turning to FIG. 4, the distal edge 38 of the arm support member 20 is shown on the left hand side of the figure. The distal edge 38 extends to the first side edge 29 at the top. The first side edge 29 gradually curves inward toward the midportion and then curves outward to form a concave portion 30. The side edge 29 continues in the rightward direction until it reaches the distal edge 41. The distal edge 41 includes a first portion 44 and a second portion 47. The second portion 47 extends beyond first portion to form a protuberance 50. The curvature of the distal edge 41 provides for visualization and access to the commonly used intravenous (IV) access currently started in the dorsal aspect of the hand for the majority of surgeries. This curvature at the distal edge 41 also allows for visualization and access to the radial artery for invasive radial arterial line monitoring. The fingers of the patient will be exposed for visualization (especially for surgical lithotomy positions) so that integrity can be assessed and $SPO_2$/Pulse $O_2$ finger probes can be adjusted easily.

The second side edge 32 extends from the proximal edge 38 along the bottom of the figure. As shown the second side edge 32 may be coplanar with a top surface of the second leg 62*a*, 62*b* of the L-shaped brackets 56*a*, 56*b*. Toward the middle of the figure, the second side edge 32 curves inward toward the central longitudinal axis 35. The curvature of side edge 32 has a radius of curvature that is less than the radius of curvature of the first side edge 29. The second side edge 32 extends to the distal edge 41. The inward curvature of the first and second side edges 29, 32 of the arm tucking device 19 provide for leaving the ulnar and lateral radial nerves of the patient padded yet exposed for visualization.

Figure 5:
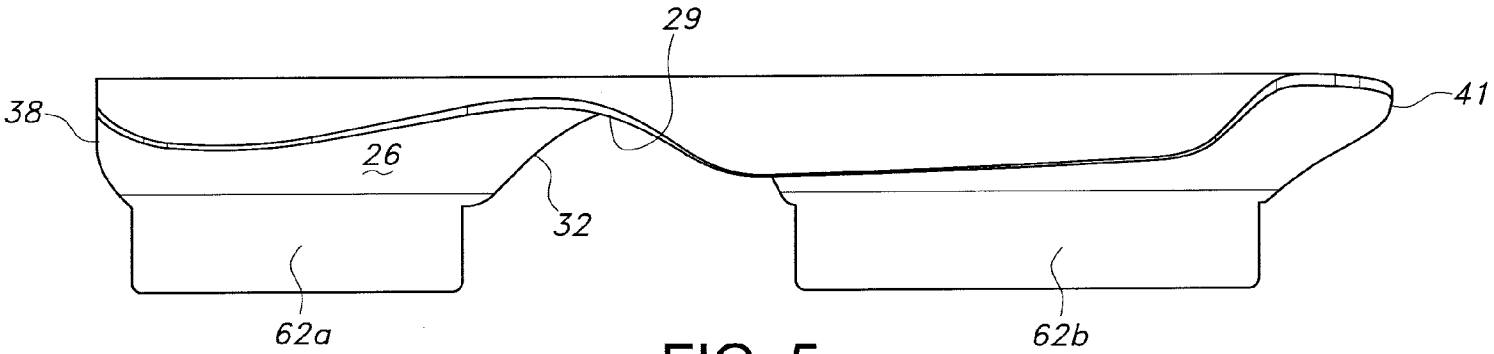
FIG. 5 is a view taken along lines 5-5 of FIG. 4.
Figure 6:
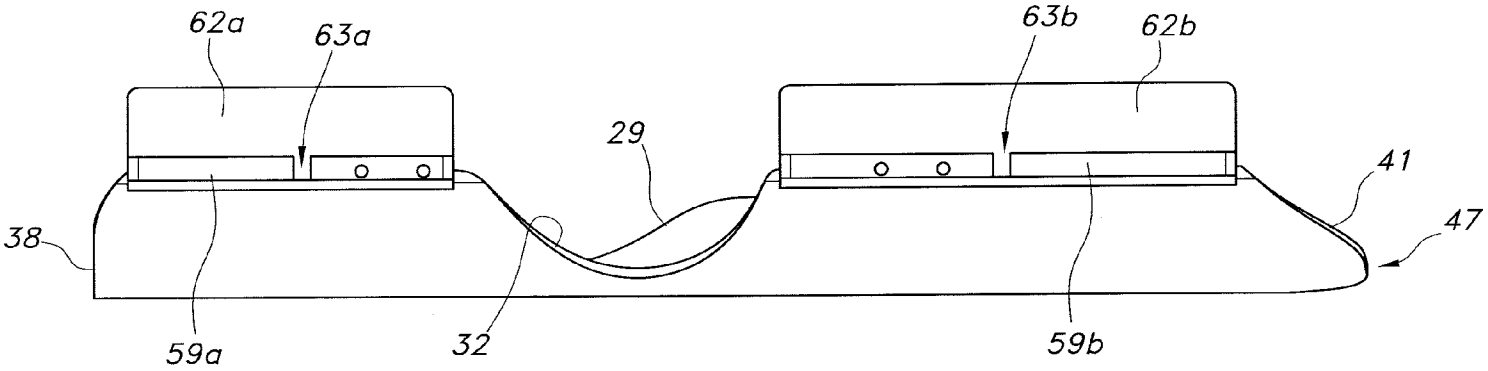
FIG. 6 is a view taken along lines 6-6 of FIG. 4.

Turning to FIG. 5, the arm support member 20 is shown in the upright "tucked" position to illustrate that the curvature of the first and second side edges 29, 32 provide openings for exposing the ulnar and lateral radial nerves. FIG. 6 shows the arm support member 20 from the opposite side of the view shown in FIG. 5. The curvature of the second side edge 32 provides an opening for exposure of the ulnar nerve of the patient.

Figure 8:
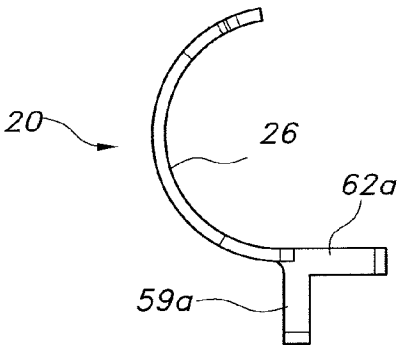
FIG. 8 is a view taken along lines 8-8 of FIG. 4.
Figure 7:
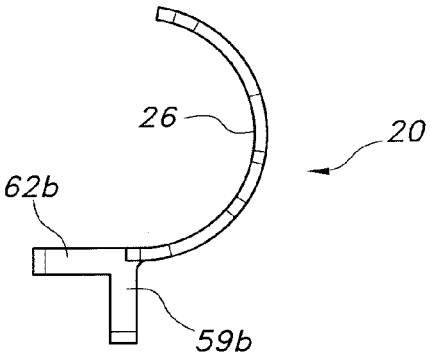
FIG. 7 is a view taken along lines 7-7 of FIG. 4.

FIGS. 7 and 8 illustrate that the arm support member 20 is curved in a cross-section taken along the longitudinal axis and the cross section may take the form of an arc of a circle, As shown the top surface 26 of the arm support member 20 may be coplanar with the second leg 62*a*, 62*b* of the L-shaped bracket 56*a*, 56*b*. The first leg 59*a*, 59*b* extends downward and pivotally engages with the structural member 23 as described in greater detail herein.

Figure 9:
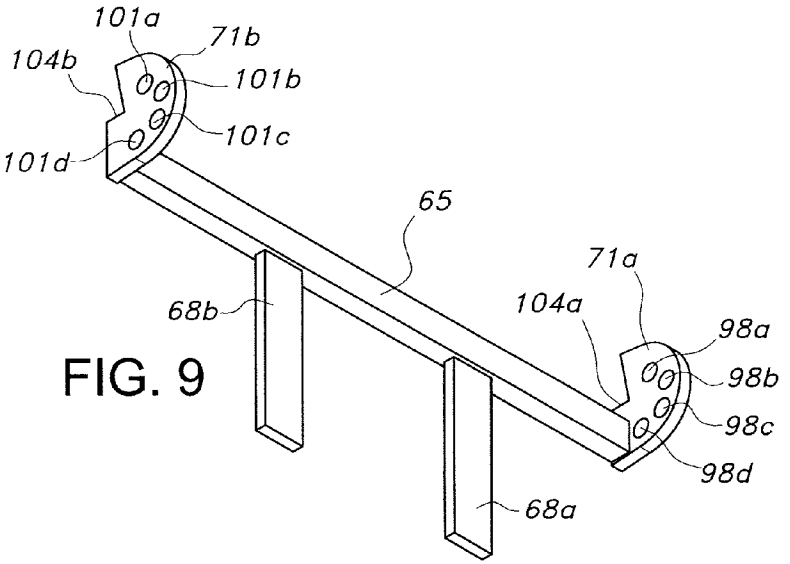
FIG. 9 is a rear perspective view of the structural member of the present invention.
Figure 11:
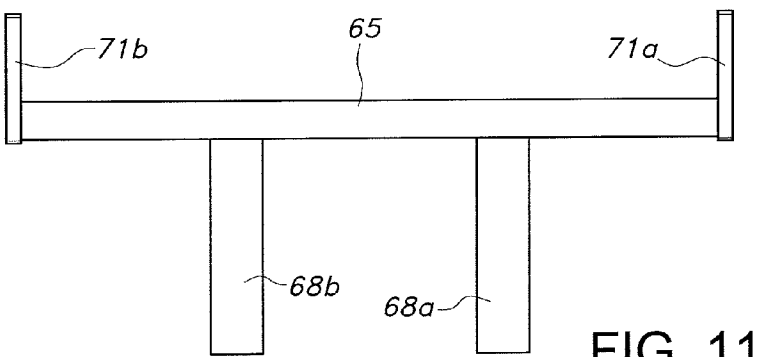
FIG. 11 is a rear elevational view of the structural member shown in FIG. 9'
Figure 10:
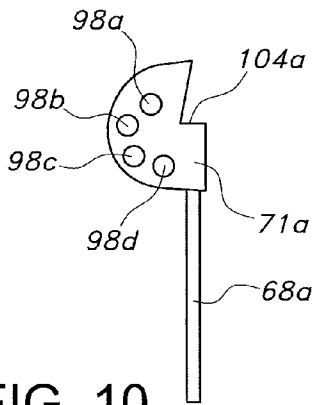
FIG. 10 is a right side elevational view of the structural member shown in FIG. 9.

In FIGS. 9-11, the structural member 23 is shown in greater detail. The structural member 23 may be molded or cast as one piece or it may be assembled from individual structural members as will be evident to those of ordinary skill in the art based on this disclosure. The structural member 23 includes a cross member 65. The mounting blades 68*a* and 68*b* extend downward from the structural member 23. A support plate 71*a* and 71*b* extends from opposite ends of the cross member 65. Support plate 71*b* has a plurality of openings 98*a-d* disposed around its periphery in a circular pattern. Support plate 71*a* may also be provided with a plurality of openings 101*a-d*. Depending on the number of angular locking mechanisms that are employed some of the openings 98 or 101 could be omitted. As best shown in FIG. 10, plate 71*a* has a shoulder 104 that is formed on the right side.

Figure 12:
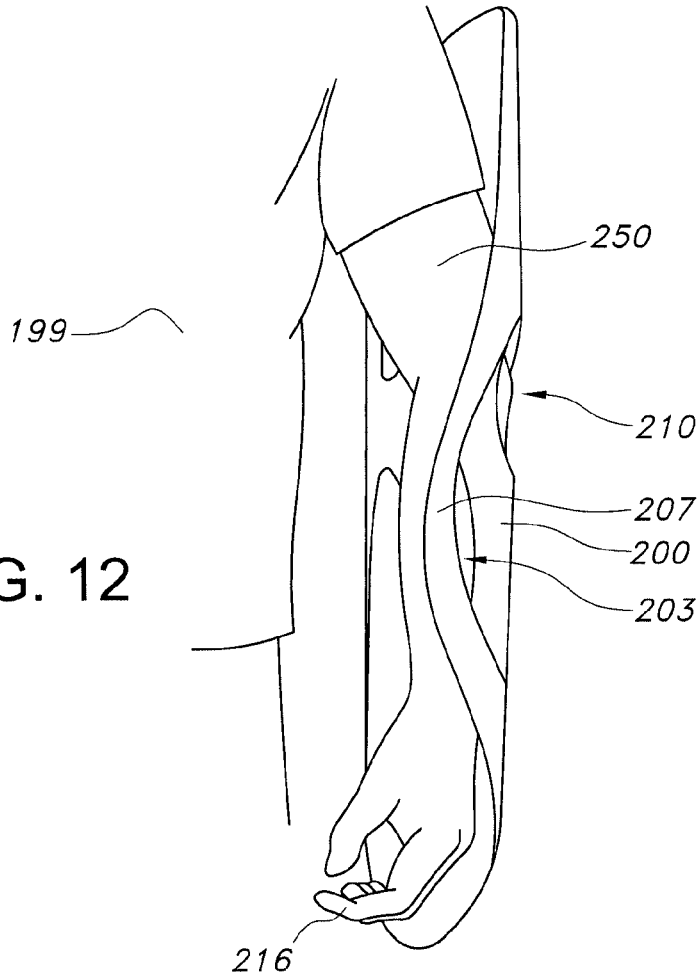
FIG. 12 is a top plan view of an alternate embodiment of the arm support member of the present invention shown in use by a patient; and, FIG. 13 is a side elevational view of the embodiment shown in FIG. 12.
Figure 13:
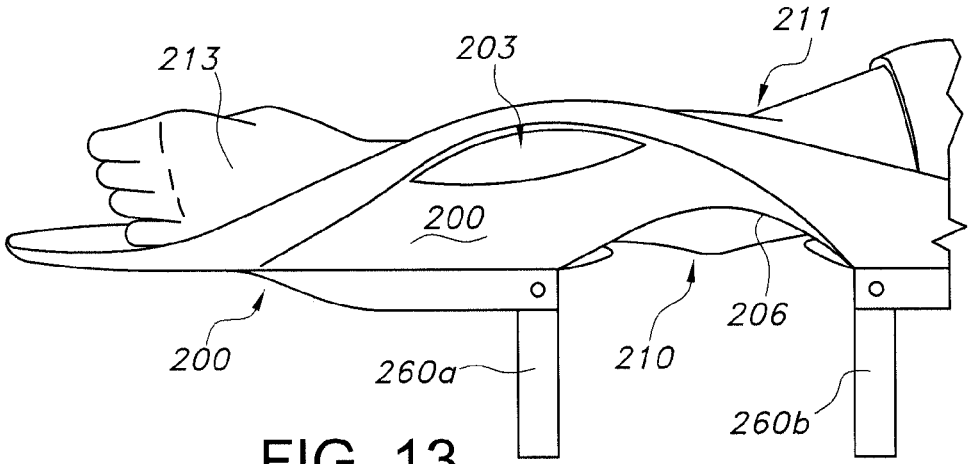

Turning to FIGS. 12-13, an alternate embodiment of the arm support member 20 is shown in relation to a patient 199. Arm support member 200 has a similar overall shape to arm support member 20 but includes an opening 203 for use with a handle 207 for grasping member 200 to move it between the loading and the "tucked" position. As shown the inward curvature of a second side edge 206 provides an opening for the ulnar nerve region 210 to be exposed. As shown the patients arm 250 is exposed in many key areas such as the ulnar nerve region 210 of the upper arm, the lateral radial nerve region 211 of the upper arm, the area 213 of the hand where intravenous (IV) catheters are typically deployed, and the fingers 216 for monitors such as pulse and $O_2$ sensors. The embodiment shown in FIGS. 12 and 13 may also be provided with mounting blades 260*a* and 260*b*.

The present invention contemplates that many changes and modifications may be made. Therefore, while the presently-preferred form of the emissions measuring system has been shown and described, and several modifications and alternatives discussed, persons skilled in this art will readily appreciate that various additional changes and modifications may be made without departing from the spirit of the invention, as defined and differentiated by the following claims.

The invention claimed is:

1. An arm tucking device for moving the arm of a patient lying in a supine position into an arm adducted position with the patient's arm tucked against the patient's body for surgery, the arm tucking device for use with a bed rail on an operating room table, the operating room table having an upper surface for supporting a patient's body, the arm tucking device comprising:

a structural support member;

an elongate arm support member disposed adjacent to the upper surface of the operating room table when the structural support member is mounted on the bed rail, the elongate arm support member pivotally attached to the structural support member, wherein the arm support member rotates only about a horizontal axis disposed parallel to the longitudinal axis of the bedrail; the arm support member having a curved top surface with first and second side edges disposed opposite from each other, the first and second side edges being disposed in spaced apart relation, the elongate arm support member configured to support the patient's arm in a generally horizontal loading position when the patient is lying in the supine position;

an angular locking mechanism for adjustably fixing an angle between the arm support member and the structural support member;

at least one pin disposed on one of the arm support member and the structural support member;

a plurality of openings defined in one of the arm support member and the structural member;

wherein the arm support member can be rotated such that the at least one pin engages with one of the plurality of openings;

wherein the arm support member can be rotated toward the center of the table, from the horizontal loading position to the arm adducted position; and, wherein the arm support member has an L-shaped bracket, the L-shaped bracket having a first leg with an opening formed therein.

2. The device of claim 1, wherein the L-shaped bracket has a second leg substantially coplanar with a top surface of the arm support member.

3. The device of claim 2, further comprising a support plate mounted on the structural member, the support plate extending through the opening in the first leg of the L-shaped bracket.

4. The device of claim 2, wherein the at least one pin is mounted on the first leg of the L-shaped bracket adjacent to the opening.

5. The device of claim 3, wherein the plurality of openings are defined in the support plate.

6. The device of claim 1, wherein the first and second side edges extend to a distal edge disposed opposite from a proximal edge.

7. The device of claim 6, wherein the first and second side edges curve inward toward the center of the top surface, the radius of curvature of the first side edge being less than the radius of curvature of the second side edge.

8. The device of claim 1, wherein the pin is biased by a spring.

9. The device of claim 6, wherein the distal edge has a first portion and a second portion.

10. The device of claim 9, wherein the second portion of the distal edge extends beyond the first portion to form a protuberance.

11. An arm tucking device for moving the arm of a patient lying in a supine position into an arm adducted position with the patient's arm tucked against the patient's body for surgery, the arm tucking use with a bed rail on an operating room table, the operating room table having an upper surface for supporting a patient's body, the arm tucking device comprising:

a structural support member;

an elongate arm support member disposed adjacent to the upper surface of the operating room table when the structural support member is mounted on the bed rail, the elongate arm support member pivotally attached to the structural support member, wherein the arm support member rotates only about a horizontal axis disposed parallel to the longitudinal axis of the bedrail; the arm support member having a curved top surface with first and second side edges disposed opposite from each other, the first and second side edges being disposed in spaced apart relation, the elongate arm support member configured to support the patient's arm in a generally horizontal loading position when the patient is lying in the supine position;

an angular locking mechanism for adjustably fixing an angle between the arm support member and the structural support member;

wherein the arm support member can be rotated toward the center of the table, from the horizontal loading position to the arm adducted position; and, wherein the arm support member has an opening defined therein to expose the ulnar nerve region of a patient whose arm is resting on the device in the tucked position.

12. A method for tucking an arm against a patient's body when a patient is disposed in a supine position in the arm adducted position on an operating room table having a bed rail, the method comprising:

providing a structural member;

providing an elongate arm support member having a curved shape in cross-section taken perpendicular to the central longitudinal axis and having a top surface with first and second side edges, the first and second side edges being disposed in spaced apart relation, the arm support member being pivotally attached to the structural member, wherein the arm support member has an opening defined therein to expose the ulnar nerve region of a patient whose arm is resting on the device in the tucked position; and, positioning the patient's arm on the arm support member with the arm support member in the first loading position;

rotating the arm support member about a horizontal axis disposed parallel to the longitudinal axis of the bedrail to the arm adducted position to tuck the patient's arm next to their body for surgery.

13. An arm tucking device for a patient's arm, the arm tucking device for mounting to a rail on an operating room table supporting a patient's body in the supine, arm adducted position, the arm tucking device comprising:

a structural member having at least one mounting blade extending therefrom, the mounting blade shaped to engage with a clamp attached to the rail on the operating table;

an elongate arm support member pivotally attached to the structural member, wherein the arm support member has an ulnar nerve opening defined therein to expose the ulnar nerve region of a patient whose arm is resting on the device in the tucked position;

at least one pin supported by one of the arm support member and the structural member;

a plurality of pin receiving openings defined in one of the arm support member and the structural member; and, wherein the arm support member can be rotated about an axis parallel to the longitudinal axis of the rail toward the center of the table from a first substantially horizontal loading position relative to the structural member where the at least one pin engages with one of the plurality of pin receiving openings to a second tucked position with the patient's arm tucked against the patient's body where the at least one pin engages with another of the plurality of pin receiving openings.

14. The device of claim 13, wherein the plurality of pin receiving openings are disposed in a curved path.

15. The device of claim 13, further comprising a mounting blade extending from the structural member, the mounting blade shaped to engage with a clamp attached to the rail on the operating room table.

* * * * *